United States Patent [19]

Holt

[11] 4,127,689

[45] Nov. 28, 1978

[54] SIMULATED STAINED GLASS ARTICLES

[76] Inventor: John F. D. Holt, 4959 Cheviot Dr., Columbus, Ohio 43220

[21] Appl. No.: 776,704

[22] Filed: Mar. 11, 1977

Related U.S. Application Data

[63] Continuation of Ser. No. 630,410, Nov. 10, 1975, abandoned.

[51] Int. Cl.[2] ..... B44F 1/06

[52] U.S. Cl. ..... 428/38; 428/151; 428/161; 428/204

[58] Field of Search ..... 428/38, 204, 151, 161; 156/63; 427/264, 265, 270, 275

[56] References Cited

U.S. PATENT DOCUMENTS

| | | | |
|---|---|---|---|
| 286,434 | 10/1883 | Herzog | 428/38 |
| 3,247,046 | 4/1966 | Fazekas | 428/38 |
| 3,533,889 | 10/1970 | Powell | 428/38 X |
| 3,900,641 | 8/1975 | Woodman et al. | 428/38 |

*Primary Examiner*—Henry F. Epstein
*Attorney, Agent, or Firm*—Fleit & Jacobson

[57] ABSTRACT

A simulated stained glass article and method for its production comprises a sheet of transparent or translucent material having at least one surface provided with an optically distorting characteristic and a thermosetting or thermofluid composition suitably colored and disposed on at least one surface to provide a desired leaded effect.

6 Claims, 4 Drawing Figures

SIMULATED STAINED GLASS ARTICLES

This is a a continuation of application Ser. No. 630,410, filed Nov. 10, 1975, now abandoned.

The present invention relates to simulated stained glass articles and their manufacture.

A conventional stained glass article such as a stained glass window comprises a plurality of sheet-like glass sections which are held together by strips of lead at their edges, the glass segments often being of different colours to provide with the shape of the lead strips, a desired decorative effect. Such stained glass articles are, however, expensive to manufacture since the required materials are expensive in themselves and the production of the articles therefrom requires considerable skill and effort on the part of the manufacturer. Furthermore, such articles do not lend themselves readily to mass production techniques.

According to the present invention there is provided a method of making a simulated stained glass article comprising the steps of treating a sheet of transparent or translucent material so that at least one surface has an optically distorting characteristic and applying to at least one surface thereof a thermofluid or thermosetting composition suitably coloured and disposed to provide a desired leaded effect.

The invention also provides a simulated stained glass article comprising a sheet of transparent or translucent material which has at least one surface provided with an optically distorting characteristic and a thermofluid or thermosetting composition on at least one surface disposed and coloured to give a desired leaded effect.

By depositing the thermofluid or thermosetting composition to a suitable thickness, it is possible to provide the leaded effect with a three-dimensional appearance. Furthermore, since unlike earlier proposals where the leaded effect has been provided by deforming the sheet itself, it is not necessary to provide a separate mould for each particular required leaded pattern. Rather, since it is possible to apply the lead effect by a screening process similar to silk screening, this invention has the advantage of being able to mass produce multiple designs of differing size and shape using the same sheet.

The invention will be further described, by way of example, with reference to the accompanying drawings in which.

Figure 1:
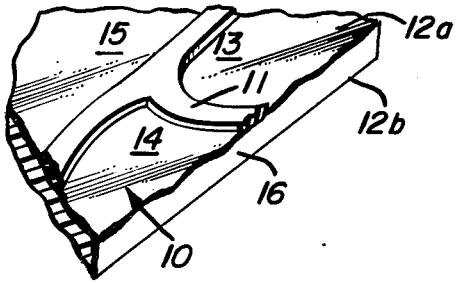
FIG. 1 is a perspective view partly in section of an embodiment of the present invention.

Referring to the drawings, in which like reference numerals have been used to denote like parts, FIG. 1 shows a simulated stained glass article 10 which comprises a sheet 16 of transparent or translucent material. Sheet 16 is formed from a plastic material such as a sheet of cellulose acetate butyrate, polycarbonate, polyester, acrylic or clear polystyrene. These plastic materials are not only relatively inexpensive but are readily available commercially. For example, cellulose acetate butyrate sheets are sold under the trademark "UVEX" by Eastman Kodak Co., polycarbonate sheets are sold under the trademark "Lexan" by General Electric Co.

and polyester sheets are available under the trademark "Mylar" from E. I. du Pont de Nemours & Co. Acrylic sheets are available from American Cyanamid Co. under the trademark "Acrylite", from Imperial Chemical Industries Ltd. under the trademark "Perspex" and from Rohm & Hass Co. under the trademark "Plexiglas". The preferred plastic material is cellulose acetate butyrate. Sheet 16 is preferably sufficiently thick for it to be self-supporting, thicknesses greater than 0.020 inches being preferred. A typically thickness for sheet 16 would be about 0.080 to 0.125 inches, with a typical surface area being 4 × 6 feet.

On one major surface **12*a* of the sheet 16*a* leaded effect is provided by means of a layer 11 of thermosetting or thermofluid composition. The layer 11 is suitably coloured to provide the desired appearance for example bronze, lead, brass, gold, silver, etc. The layer 11 should be sufficiently thick to provide the desired three-dimensional effect of the leading. A typical thickness for the layer 11 will be in the range ½ to 3 millimeters, with 2 to 3 millimeters being preferred for most applications. The sheet 16 is divided up into panels 13, 14 and 15 by the layer 11, the panels 13, 14 and 15 being suitably so shaped, together with the layer 11, as to provide the desired decorative pattern of the finished article. The colouring of the panels 13, 14 and 15 may, as will be described later, be provided by applying either to the surface 12*a*, 12*b* or both of the sheet 16 coatings or layers such as 13*a*, 14*a* of transparent or translucent coloured ink. Such coatings or layers of ink may suitably have ultra-violet inhibiting properties and be applied to either or both surfaces of sheet 16 by silk screening. The sheet 16 is provided with an optically distorting characteristic for the panels 13, 14, 15 either before or after the application of layer 11 and/or coatings or layers 13*a*, 14*a***.

Some of the areas 13, 14 and 15 will be left unprinted by coloured ink so that such areas appear to be the same in colour as the sheet 16 which, of course, will usually either be clear or neutral in colour.

Figure 2:
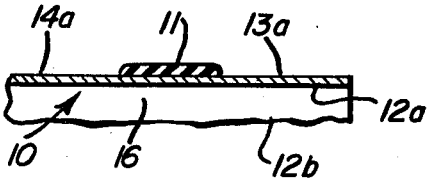
FIG. 2 is a transverse sectional view of the simulated stained glass article shown in FIG. 1.

It will be appreciated that in FIG. 2 the thicknesses of the layers 11, **14*a* and 13*a* are not drawn to scale, the thickness of the coloured ink layers 14*a* and 13*a* being very much less in comparison with that of the layer 11** than that shown in the Figures.

Figure 3:
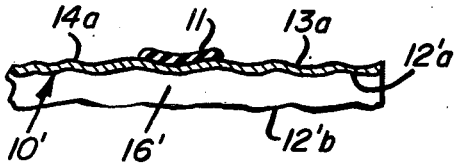
FIG. 3 is a sectional view through a second embodiment of the invention.

FIG. 2 shows a preferred embodiment of the invention in which layer 11 is applied to the smoother surface **12*a* of the sheet 16 and in which the opposite surface 12*b* is optically distorting in a manner similar to that of actual stained glass articles. In FIG. 3, the optical distortion is provided by irregularities on both surfaces 12'*a* and 12'*b* of the sheet 16'**.

In order to enhance the three-dimensional effect of the layer 11 which produces the leaded effect it is possible to darken the areas of the surface **12*b* or 12'*b* of the sheet 16 or 16', respectively, which are in register with the layer 11. This darkening may suitably be achieved by printing on the surface 12 or 12'*b*** a layer of dark opaque ink by a silk-screening process.

A stained glass article in accordance with the invention may suitably be produced by one of the five following methods:

1. A transparent or translucent sheet of plastic material having smooth surface **12*a* and 12*b*** is silk-screened with one or more ultra-violet inhibiting transparent or translucent coloured inks to provide the desired design on one or both surfaces of the sheet. The printed sheet is roller coated to provide optically distorting characteristics for one or both surfaces of the sheet. The leading effect is then applied to either or both surfaces of the sheet by one of the methods to be described later. If only one of the surfaces is provided with an optically distorting surface, the leading effect is preferably applied to the smooth surface. The completed sheet is then cut or die stamped if necessary to provide the desired shape and size of the finished article.

2. A transparent or translucent sheet of plastic material having smooth surfaces 12*a* and 12*b* is vacuum or compression formed or extruded so that either or both surfaces thereof are optically distorting to give an appearance similar to that of "antique" glass. The deformed sheet is trimmed if necessary to provide it with suitably straight edges and if required cut to smaller blanks of varying sizes depending on the end product. Then the different coloured panels such as 13, 14 and 15 are successively applied to one or both surfaces of the deformed sheet by silk-screening. The leading effect is applied by one of the methods to be described later.

3. A transparent or translucent plastic sheet having smooth surfaces 12*a* and 12*b* is silk-screened with one or more ultra-violet inhibiting transparent or translucent coloured inks to provide the desired coloured design on one or both surfaces. Thereafter, the leading effect is applied to one of the surfaces by one of the methods to be described later. The opposite surface of the sheet is then vacuum formed to give it an optically distorting characteristic. The formed sheet is then suitably cut or die stamped, if necessary, to provide the required shape and size of the finished article.

4. A transparent or translucent sheet of plastic material is silk-screened with one or more ultra-violet inhibiting transparent or translucent coloured inks to provide the desired design on one or both surfaces of the sheet. The thus printed sheet is vacuum formed to provide optically distorting characteristics for both surfaces of the sheet and is then trimmed. The leading effect is then applied to either or both surfaces of the sheet by one of the methods to be described later. The completed sheet is then cut or die stamped if necessary to provide the desired shape and size of the finished article.

5. A sheet is injection-moulded in a mould having a suitably shaped moulding cavity to provide optically distorting characteristics for either or both surfaces of the finished sheet. This sheet is then overprinted on either or both surfaces with one or more ultra-violet inhibiting transparent or translucent inks and the leading effect is applied. Thereafter, the sheet is cut or die stamped to provide the desired shape and size of article. Clearly, since with this method it is necessay to manufacture a mould which will give the desired optically distorting characteristics, the method is more suitable for long production runs.

Figure 4:
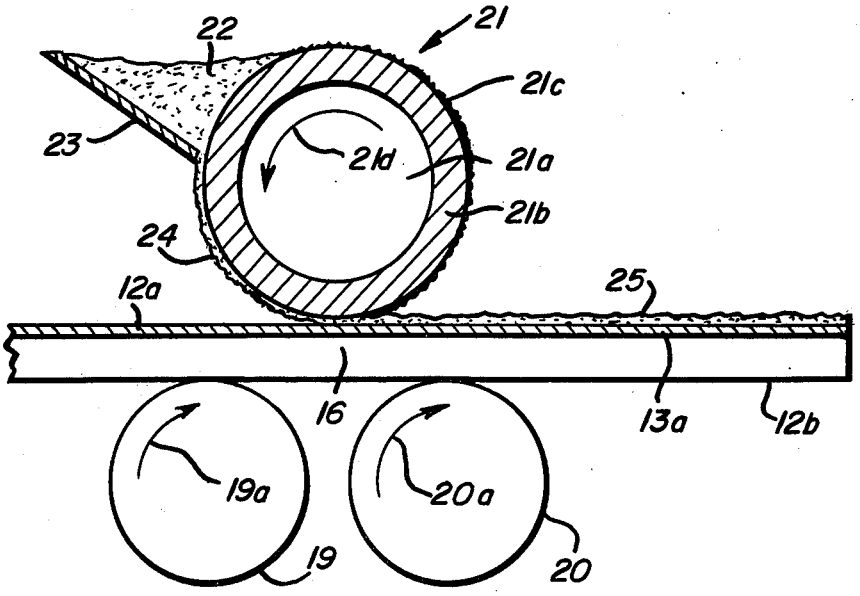
FIG. 4 is a schematic cross-section of one method of providing an optically distorting characteristic for the simulated stained glass article of the present invention.

The first method is generally preferred. The roller coating process of this method is as illustrated in FIG. 4. The sheet 16 is transported through the roller coating station by conveyor rollers 19 and 20 which are rotated in the direction of arrows 19*a* and 20*a*, respectively. A coating is applied to the surface of sheet 16 by roller 21. Roller 21 typically comprises a core 21*a* and a casting 21*b* conveniently formed from a room temperature vulcanizing silicon rubber or metal. The surface of coating 21*b* is distorted as shown at 21*c*. Liquid coating material 22 is fed from well or reservior 23 onto the surface of roller 21 and in the direction of arrow 21*d* to form coating 24. The roller then transfers coating 24 to the surface of sheet 16 to form distorted coating 25 which has a "grain leather" appearance and provides an optically distorting characteristic to the finished simulated stain glass article. As will be appreciated, a plurality of rollers can be used to apply and deform the coating 25. For example, a first roller could be employed having a smooth surface to apply the coating and a second roller having a distorted surface to distort the coating.

The liquid material used to form the optical distorting coating is generally clear and plastic such as a resin, epoxy, or an air drying silk screening base unadulterated by normal thinners and/or extenders. The liquid material should have a high gloss finish and strong thixotropic properties. In the case of a resin or epoxy, the liquid material should be catalyzed prior to being coated on the roller. In this manner a coating of varying thickness and pattern can be deposited which can vary in thickness from 0.001 to 0.060 inches, the latter being generally preferred. After the coating has been applied, it is preferred to accelerate the drying time by using blowers or other means which are conventional in the art, particularly in silk screen printing. Since the substrate can be printed as shown in FIG. 4 at 13*a* prior to roller coating, the optical distorting layer can be used to protect it. Also, as mentioned above, both surfaces of the substrate can be roller coated if desired to get doubly strong optical distortion. An ultra violet inhibitor can be added to the liquid coating thereby increasing the protection of the colours in the product to U.V. fading.

The second method is also a preferred method, particularly in combination with vacuum forming rather than compression forming or extrusion. The vacuum forming method is conventional and comprises heating the plastic sheet to a suitable temperature and then laying or placing the sheet on the mould which has a distorted or "grain leather" surface. Air is extracted through the holes in the mould so that the sheet is drawn by suction against the distorted mould surface. The surface of the sheet in contact with the mould face is thereby distorted while the other surface remains substantially smooth. The temperature to which the plastic sheet is heated before being contacted with the mould with depend on the plastic material and thickness, with a temperature of 230° to 270° F. being typical for cellulose acetate butyrate, for example. The mould surface is not normally heated directly and the sheet is typically cooled by circulating air past the sheet with fans while the sheet is in contact with the mould.

With all these methods, the sheet may be provided with more than one repeat of the required design or with multiple designs of varying shape and size and then the designs separated either by die stamping or cutting after the leading effect has been applied to separate the designs.

The layer 11 in FIGS. 1 to 3 which provides the leaded effect in the methods 1, 2, 3, and 5 described above is preferably produced in one of the two following ways:

Where a thermofluid composition is used, the thermofluid composition comprises a specially formulated hard wax base and fillers appropriate to give strong adhesion to the sheet and also good abrasion qualities. The wax base also contains pigments which give the desired colouring for the layer 11 so that the produced leaded effect resembles, for example, bronze, lead, brass or silver. The thermofluid composition is suitably applied to the sheet to form the layer 11 by passing the composition through a metal screen which has a pattern of apertures therein corresponding to the desired shape of the layer 11. By making the apertures sufficiently small in relation to the dimensions of layer 11 and sufficiently large in number it is possible to arrange a well controlled and even deposition of the layer 11. The thermofluid composition will normally need to be heated so that it may be caused to flow through the apertures in the metal screen onto the surface of the sheet and for this purpose an electric current may be passed through the metal screen to provide a heating. The layer 11 is built up by one or more passes of a pressure member such as a squeegee over the face of the screen remote from the sheet. During each pass a layer of composition is deposited on the sheet and hardens virtually instantaneously because of the lower temperature of the sheet. It has been found that the layer 11 formed in this manner may subsequently soften if the leaded sheet is subsequently subjected to vacuum forming; however, since the composition has a high thixotripic quality and surface tension the layer is not caused to move from its original configuration with careful vacuum forming.

Secondly, the leaded effect of layer 11 may be formed by depositing a thermosetting composition on the sheet using a screen similar to that described in connection with the deposition of the thermofluid composition with the exception that no electric current is required. This composition is preferably highly thixotropic, suitable materials being polyester resins or epoxy bases with suitable fillers, should have very strong adhesion characteristics and resistance to abrasion and tensile stress. Again, suitable pigments may be added to the thermosetting composition to give the desired appearance of the leaded effect. A catalyst may be added to the composition prior to pouring it onto the metal screen, or other suitable screen, particularly with thermosetting compositions such as epoxy resins which are not air drying, the catalyst serving to determine the drying time. Alternatively, an air drying highly thixotropic silk-screening ink can be employed. Again, the layer 11 of thermosetting composition may be built up by successively depositing layers of composition by repeated passes, typically two to five, of a pressure member over the remote surface of the screen, the amount of composition deposited during each step being determined by the dimensions of the apertures and gauge in the screen. As will be appreciated, the thermosetting composition must be allowed to dry between the repeated passes of the pressure member.

Several applications of the thermofluid or thermosetting compositions result in building up a three dimensional pattern corresponding to and separating the various coloured sections 13, 14 and 15 with the visual effect that the coloured sections are individual pieces apparently held together by "metal ridges". A further improvement can be added to this illusion by finishing the three-dimensional ridges with a bright contrasting "solder" effect by printing a heavy deposit of such material at the "joints" of the ridges.

It is sometimes desired to make a simulated stained glass article in a non-planar shape, for example in the form of a cone, part-sphere or tube as for example, in the case of ornamental lampshades. Clearly, where the sheet forming the article is vacuum formed after the coloured patterns and leaded effect has been applied to it, it is necessary in some cases to "predistort" the pattern of the coloured areas and the leaded effect so that this pattern will be distorted into the desired pattern during the vacuum forming operation.

As will be appreciated from the foregoing, the optically distorting characteristic of the simulated stain glass article can be provided either by deforming the surface of the sheet 16 or by deforming a coating applied to a surface of the sheet 16. Furthermore, although specific methods have been described for providing the optically distorting characteristic, it should be appreciated that other methods can also be employed.

What I claim is:

1. A simulated stained glass article comprising a sheet of transparent or translucent plastic material having two major surfaces, at least one of said major surfaces being deformed to distort or refract light incident thereon, said distortion or refraction of light being caused solely by said deformation of said at least one of said major surfaces, a thermofluid or thermosetting composition disposed on at least one of said major surfaces thereof and coloured to give a leaded effect, said thermofluid or thermosetting composition comprising a plurality of layers which provide a three dimensional appearance for said leaded effect, and at least one coloured ink printed on at least one of said major surfaces to give a decorative effect between the areas of the sheet having said leaded effect.

2. An article according to claim 1 wherein each ink has ultra-violet inhibiting properties.

3. An article according to claim 1 wherein the leaded effect comprises either an epoxy base resin containing fillers therein or a polyester resin.

4. An article according to claim 1 wherein said thermofluid or thermosetting composition is disposed on said at least one deformed major surface.

5. A simulated stained glass article comprising a sheet of transparent or translucent plastic material having two major surfaces, both of said major surfaces being deformed to distort or refract light incident thereon, said distortion or refraction of light being caused solely by said deformation of said both of said major surfaces, a thermofluid or thermosetting composition disposed on at least one of said deformed major surfaces thereof and coloured to give a leaded effect, said thermofluid or thermosetting composition comprising a plurality of layers which provide a three dimensional appearance for said leaded effect, and at least one coloured ink printed on at least one of said major surfaces to give a decorative effect between the areas of the sheet having said leaded effect.

6. A simulated stained glass article providing a plurality of decorative panels separated by a leaded effect comprising a sheet of transparent or translucent plastic material having two major surfaces, at least one of said major surfaces being deformed to distort or refract light incident thereon, said distortion or refraction of light being caused solely by said deformation of said at least one of said major surfaces, a thermofluid or thermosetting composition disposed on at least one of said major surfaces thereof and coloured to give a leaded effect, said thermofluid or thermosetting composition comprising a plurality of layers which provide a three dimensional appearance for said leaded effect, said thermofluid or thermosetting composition dividing up said sheet into a plurality of panels, and at least one coloured ink printed on at least one of said major surfaces to give a decorative effect to said plurality of panels, said at least one coloured ink providing a plurality of different decorative effects for said panels.

* * * * *